United States Patent [19]

Maa

[11] 4,123,347

[45] Oct. 31, 1978

[54] COAL LIQUEFACTION PROCESS

[75] Inventor: Peter S. Maa, Baytown, Tex.

[73] Assignee: Exxon Research & Engineering Co., Linden, N.J.

[21] Appl. No.: 836,821

[22] Filed: Sep. 26, 1977

Related U.S. Application Data

[63] Continuation-in-part of Ser. No. 753,215, Dec. 22, 1976, abandoned, which is a continuation-in-part of Ser. No. 641,489, Dec. 17, 1975, Pat. No. 4,022,680, which is a continuation-in-part of Ser. No. 607,433, Aug. 25, 1975, abandoned.

[51] Int. Cl.[2] ..... C10G 1/04; C10G 1/08

[52] U.S. Cl. ..... 208/8; 208/10

[58] Field of Search ..... 208/8, 10

[56] References Cited

U.S. PATENT DOCUMENTS

| | | | |
|---|---|---|---|
| 2,202,901 | 6/1940 | Dreyfus | 208/8 |
| 3,505,203 | 4/1970 | Nelson | 208/8 |
| 3,692,662 | 9/1972 | Wilson et al. | 208/8 |

FOREIGN PATENT DOCUMENTS

| | | | |
|---|---|---|---|
| 1,287,570 | 8/1972 | United Kingdom | 208/8 |

*Primary Examiner*—Delbert E. Gantz
*Assistant Examiner*—Joan Thierstein
*Attorney, Agent, or Firm*—L. A. Proctor; Wayne Hoover

[57] ABSTRACT

A process for liquefying a particulate coal feed to produce useful petroleum-like liquid products which comprises contacting; in a series of two or more coal liquefaction zones, or stages, graded with respect to temperature, an admixture of a polar compound; or compounds, a hydrogen donor solvent and particulate coal, the total effluent being passed in each instance from a low temperature zone, or stage to the next succeeding higher temperature zone, or stage, of the series. The temperature within the initial zone, or stage, of the series is maintained about 70° F and 750° F and the temperature within the final zone, or stage, is maintained between about 750° F and 950° F. The residence time within the first zone, or stage, ranges, generally, from about 20 to about 150 minutes and residence time within each of the remaining zones, or stages, of the series ranges, generally, from about 10 minutes to about 70 minutes. Further steps of the process include: separating the product from the liquefaction zone into fractions inclusive of a liquid solvent fraction; hydrotreating said liquid solvent fraction in a hydrogenation zone; and recycling the hydrogenated liquid solvent mixture to said coal liquefaction zones.

13 Claims, 1 Drawing Figure

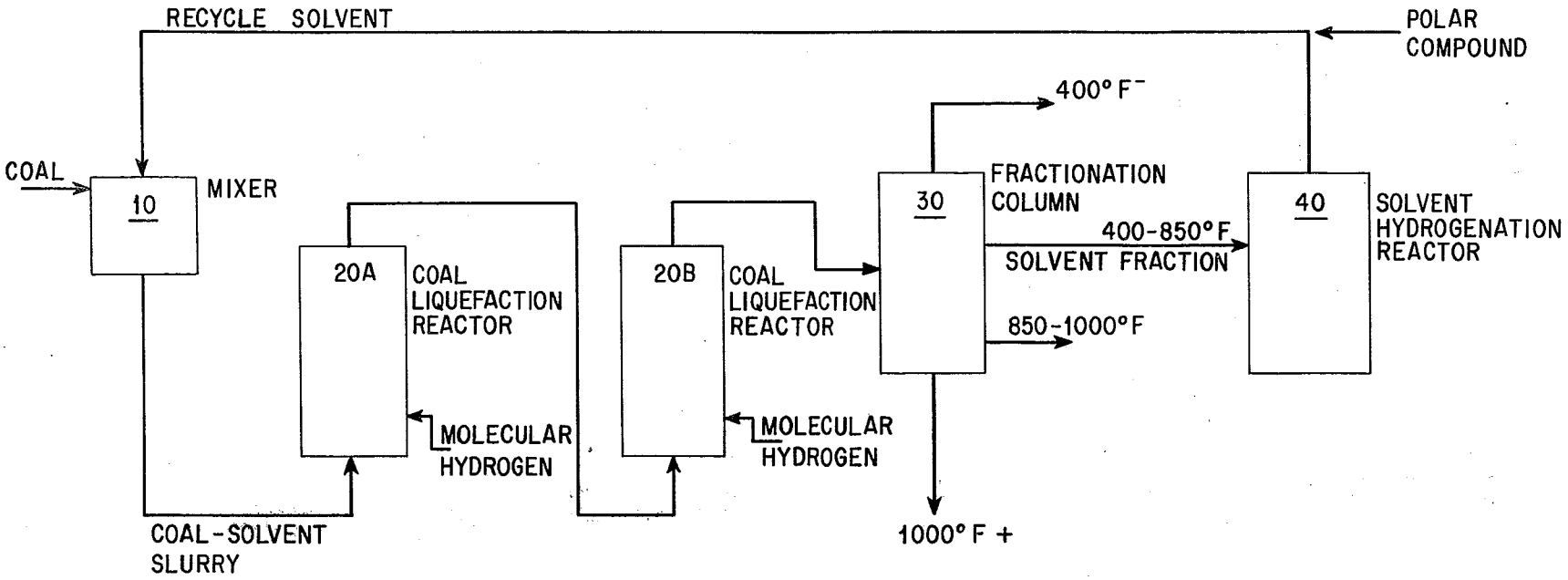
COAL
10
MIXER
RECYCLE SOLVENT
20A
COAL LIQUEFACTION REACTOR
MOLECULAR HYDROGEN
COAL-SOLVENT SLURRY
20B
COAL LIQUEFACTION REACTOR
MOLECULAR HYDROGEN
30
FRACTIONATION COLUMN
400° F⁻
400-850° F SOLVENT FRACTION
850-1000° F
1000° F +
40
SOLVENT HYDROGENATION REACTOR
POLAR COMPOUND

COAL LIQUEFACTION PROCESS

The government of the United States of America has rights in this invention pursuant to Contract No. E(49-18)-2353 awarded by the U.S. Energy Research and Development Administration.

RELATED APPLICATIONS

This is a continuation-in-part of application Ser. Nos. 607,433 filed Aug. 25, 1975, now abandoned, 641,489 filed Dec. 17, 1975 now U.S. Pat. No. 4,022,680 and 753,215, filed Dec. 22, 1976 now abandoned.

BACKGROUND OF THE INVENTION

Hydrogen donor solvent processes for use in the hydrogenation and liquefaction of coal are of particular interest among known coal conversion processes for the production of useful petroleum-like liquids, i.e., 1000° F.− liquid products. In such processes, crushed coal is contacted at elevated temperature and pressure with a solvent, often a liquid fraction derived from within the process, which acts as a hydrogen transfer agent or donor. The solvent supplies hydrogen to the hydrogen-deficient coal molecules, as molecules are thermally cracked and cleaved from the disintegrating coal solids.

Coal is largely comprised of polymerized multi-ring aromatic structures, and in the breaking coal molecules each bond rupture results in the formation of extremely reactive free radicals. These moities, when early stabilized by the addition of a hydrogen atom, if sufficiently small, may be evolved as a portion of the desired petroleum-like liquid product. If the moities become excessively large before they are stabilized, undesirable 1000° F.+ liquid products can form. Also, the moities can form polymeric products, and the fragments may remain with, or form a part of the char or coke that is produced. Sufficient hydrogen must be available, and effectively utilized to avoid repolymerization of the moities to form char or choke.

Coal, of course, is not a pure hydrocarbon. It contains volatile matter, fusain, mineral matter and sulfur, much as pyritic sulfur, inorganic sulfates and organic sulfur compounds. Coal also contains bitumin and humin which have large, flat, aromatic, lamellar structures that differ in molecular weight, degree of aromaticity, oxygen and nitrogen contents and degree of cross-linking. The product liquids produced from coal thus vary widely in composition. Whereas much of the coal has been successfully converted to useful petroleum-like liquids, the amount of such liquids which can be produced is quite variable. The liquid products themselves also vary considerably in composition, and liquids are only a portion of the total products that are produced. The product liquids contain fusinite and ash, as well as char and sludge, which must be separated from the liquids. The heavy products from such coal liquefaction processes, characterized as "liquefaction bottoms" and consisting of 1000° F.+ organics, ash and carbon residue (fusinite), consist largely of carbon, 60–70 weight percent, and about 20 weight percent ash. The liquefaction bottoms, which are less useful than the 1000° F.− liquids, generally contain 45–55 weight percent of the original feed coal to the process.

Various attempts have been made to convert more of the carbon of the coal to useful liquid products. It is thus desirable to obtain higher levels of conversion, and to reduce the level of formation of the excessively high molecular weight hydrocarbons which occur in the process. One approach to improving carbon efficiency is described, e.g., in U.S. Pat. No. 3,700,583 issued to Salamony et al on Oct. 24, 1972. This process describes the use of quinones, particularly quinone derivatives of mono- and/or polynuclear aromatic compounds, certain halogens and halogen halides thereof as carbon-radical scavengers which are added with the hydrogen donor solvent to the coal liquefaction zone to increase the amount of low molecular weight hydrocarbons which are formed within the liquid product, as measured by an increase in the total amount of benzene-soluble liquids in the product.

Higher levels of conversion have also been obtained by the use of polar solvents added to the coal liquefaction zone as described in application Ser. Nos. 607,433 and 641,489, supra. In accordance with the processes described in the former application, a heterocyclic nitrogen compound, or mixture of heterocyclic nitrogen compounds, and in the latter application a heterocyclic oxygen or sulfur compound, or admixture of such compounds, is added to a donor solvent fraction indiginous to the process, and the donor solvent, containing the added polar-solvent in suitable concentration, is recycled to the coal liquefaction zone, thus increasing the conversion of coal to lower molecular weight, more useful petroleum-like liquid products than obtainable in a process otherwise similar except that no polar solvent was employed. It is believed that the polar compounds progressively enhance dispersion of the high molecular weight compounds, notably those boiling at 1000° F.+, as liquefaction of the coal proceeds. The free radicals produced by the thermal cracking of the large coal molecules are thus known to be extremely short-lived, and are formed principally at the solid interfaces wherein the coal solids particles are being dissolved. By improving contact between the hydrogen donor solvent and these moities, repolymerization of some of these moities with other molecules or with each other is suppressed. The greater effectiveness of the hydrogen donor molecules in their role of reaching the extremely reactive-free radicals as they are formed, and more effectively hydrogenating said radicals is thus believed to account largely for these improvements.

Whereas processes utilizing the addition of polar solvents to the donor solvent offer advantages over prior art processes, such process has, nonetheless, been found susceptible of further improvement.

Among the objects of this invention are:

To provide a new and improved process wherein polar solvents are employed to provide further increased yields of the desirable 1000° F.− petroleum-like liquid products with further decreased levels of coke or char.

To provide a new and improved hydrogen donor coal liquefaction process, particularly one which utilizes a polar solvent or compound to produce greater quantities of the more useful petroleum-like liquids, with decreased amounts of char and coke.

SUMMARY OF THE INVENTION

These and other objects are achieved in accordance with the present invention characterized generally as a process for liquefying a coal feed to produce useful petroleum-like liquid products which comprises contacting, in a series of coal liquefaction zones or stages, graded with respect to temperature such that the temperature ascends from the initial to the final zone, or stage, of the series, an admixture of a polar compound, or polar compounds, a hydrogen donor solvent and particulate coal, the total effluent being passed in each instance from a low temperature zone, or stage, to a next succeeding higher temperature zone, or stage, of the series.

BRIEF DESCRIPTION OF THE DRAWING

The figure is a flow diagram of a multistage liquefaction process within the scope of this invention.

DESCRIPTION OF THE PREFERRED EMBODIMENT

The temperature within the initial zone, or stage, is maintained between about 70° F. and 750° F., preferably between about 600° F. and 720° F., and the temperature within the final zone, or stage, being maintained between about 750° F. and 950° F., preferably between about 800° F. and 880° F. Suitably, the liquefaction of the coal feed is conducted in a series of from 2 to about 10 zones, or stages, preferably from 2 to about 5 zones, or stages, the temperature gradient between the several zones, or stages, being regular or irregular, i.e., substantially exponential, linear or nonlinear, as measured from the first to the last zone, or stage, of the series. The residence time within each of the low temperature zones, or stages, of the series ranges from about 20 minutes to about 150 minutes, preferably from about 30 minutes to about 120 minutes. The residence time within each of the high temperature zones or stages of the series ranges from about 10 minutes to about 70 minutes, preferably from about 15 minutes to about 50 minutes. Whereas it is quite feasible to employ a higher residence time in the high temperature zones or stages, no significant benefit results from such increase in residence time. The product of the liquefaction which is taken from the final stage or zone of the series is then separated, suitably by distillation, into fractions inclusive of a liquid solvent fraction which contains at least 30 weight percent and, preferably, at least 50 weight percent hydrogen donor compounds, particularly those fractions boiling within about the 350°-850° F. range, and preferably within about the 400°-700° F. range; the liquid solvent fraction is then hydrogenated in a hydrogenation zone and the liquid solvent fraction and, preferably, the polar compound is then recycled to the first coal liquefaction stage.

By staging the coal liquefaction portion of the process in terms of an ascending temperature gradient, measured from the first to the last coal liquefaction stage of the series, there results an increase of the desirable 1000° F.− liquids and a corresponding decrease in the production of 1000° F.+ liquids and solids; vis-a-vis a process similarly conducted except that the coal liquefaction portion of the process is not staged. The reason for the effectiveness of the staging is not understood though it is believed that the staging in effect regulates the type of free radical formation in the different stages and provides better timing and opportunity for the transport of hydrogen to the reactive sites for the early, or timely, healing of the extremely reactive moities, or free radicals that are generated. This type of staging is believed to provide more opportunity for the formation of the desirable 1000° F.− liquids and, conversely, less opportunity for repolymerization of the reactive moities.

In its preferred aspects the polar compound in terms of its chemical composition is characterized as (i) a heterocyclic nitrogen compound which contains from 4 to 5 carbon atoms in its nucleus, and one or more atoms of nitrogen preferably one nitrogen atom;

(ii) a low molecular weight heterocyclic oxygen compound containing from 2 to about 6 and, preferably, from 2 to 3 fused rings, one or more and preferably one of which is a five- or six-membered heterocyclic ring having from 4 to 5 carbon atoms in the nucleus, preferably 4 carbon atoms, and from 1 to 2 atoms of oxygen preferably one atom of oxygen; or (iii) a low molecular weight heterocyclic sulfur compound containing from 2 to about 6, and preferably from 2 to 3 fused rings, one or more and preferably one of which is a five- or six-membered heterocyclic ring having from 4 to 5 carbon atoms in the nucleus, preferably 4 carbon atoms, and from 1 to 2 atoms or sulfur, preferably one atom of sulfur.

The heterocyclic nitrogen compound or mixture of heterocyclic nitrogen compounds added to the coal generated solvent fraction is one which is polar, stable, and capable of dissolving at the conditions of operation, the high molecular weight hydrocarbons within the reaction mixture, particularly the 1000° F.+ hydrocarbons. It is thus a strong solvent whether or not it possesses hydrogen donor capabilities, but it may be both a strong solvent and a hydrogen donor compound or mixture of such compounds. In terms of chemical composition, the heterocyclic nitrogen compound is one which contains from 4 to 5 carbon atoms and one or more, suitably 1 or 2 and preferably one, nitrogen atom in its nucleus. The ring structure can be fused or nonfused, substituted or nonsubstituted, and in terms of carbon atoms the total molecule can contain from 4 to about 36 carbon atoms preferably from 4 to about 20 carbon atoms, and most preferably from 5 to about 12 carbon atoms. Ring substituents which increase the polarity of the total molecule are particularly desirable, such groups as oxy, hydroxy, nitro, amino, acetamide, carboxy, carboxy amide, halo, alkyl, alkoxy, phenoxy, and the like being preferred substituents, notably the methyl, methoxy, ethyl and ethoxy substituents. The substituting groups themselves can be substituted or unsubstituted, and more than one substituent, or substituting group can be contained upon the ring of the heterocyclic nitrogen compound. Where the substituent ring is fused, the fused substituent groups preferably contain from 3 to 4 carbon atoms within a substituent ring (ex those carbon atoms constituting a portion of the nucleus of the heterocyclic nitrogen compound), and preferably from about 1 to 2 substituent rings, which can contain atoms which are the same or different from those constituting the basic heterocyclic nitrogen compound, and can contain oxygen, nitrogen or sulfur within the ring, or attached to a ring carbon atom. Exemplary of such heterocyclic nitrogen compounds of this character are pyrrole, pyrrolidone, n-methyl pyrrolidone, pyridine, β-picoline, β-phenoxy-picoline, β-cresyl-picoline, 2-acetamido-pyridine, 1-acetyl-piperidine, 1,2,3,4-tetrahydroquinoline, 2-acetamidoquinoline, 10-benzylacridan, and the like.

The heterocyclic oxygen or heterocyclic sulfur compound is one comprised of fused polycyclic rings, suitably containing from 2 to about 6 and, preferably, from 2 to 3 fused rings, at least one and, preferably, one of which is a five- or six-membered heterocyclic ring having from 4 to 5 carbon atoms in its nucleus, preferably 4 carbon atoms, and from 1 to 2, preferably one, atom which is either oxygen or sulfur. The heterocyclic ring is fused to another ring or to more than one other ring which can be heterocyclic or nonheterocyclic, particularly aromatic. The molecule can be substituted or unsubstituted and in terms of carbon atoms the total molecule can contain from 8 to about 36 carbon atoms, preferably 8 to about 20 carbon atoms, and most preferably from 8 to about 12 carbon atoms. Ring substituents which increase the polarity of the total molecule are particularly desirable, such groups as oxy, hydroxy, nitro, amino, acetamide, carboxy, carboxy amide, halo, alkyl, alkoxy, phenoxy and the like, be preferred substituents, notably the methyl, methoxy, ethyl and ethoxy substituents. The substituting groups, themselves, can be substituted or unsubstituted and more than one substituent, or substituting group can be present in the molecule. The substituent group, or groups, can contain oxygen, nitrogen, or sulfur within the ring or attached to a ring carbon atom. Exemplary of heterocyclic oxygen compounds of this character are benzofuran, naphthenobenzofuran, dibenzofuran, naphthenodibenzofuran, phenanthrenofuran, naphthenophenanthrenofuran, 1,2-benzopyran, 2-furo[3,4-c]-pyrazole, 2,7-dioxapyrene, spiro[benzofuran-3(2),4'-piperidine], and the like, and exemplary of heterocyclic surfur compounds of this character are benzothiophene, naphthenobenzothiophene, dibenzothiophene, naphthenodibenzothiophene, phenanthrenothiophene, naphthenophenanthrenothiophene, 2-(o-nitropheyldithio)benzothiazole, 10-thiaxanthenol, and the like.

The polar compound is desirably one which also either possesses or can be hydrogenated such that it will possess donatable hydrogen in or near the ring, or both. Where the hydrogen donor quality does not exist in the polar compound, however, this function can and must be added by admixture with a compound, or admixture of compounds, which supplies this characteristic. The polar compound in its role as a hydrogen donor is thus an unsaturated compound of considerable stability at coal liquefaction conditions which can be further hydrogenated, preferably an aromatic compound which can be hydrogenated in situ or ex situ of the coal liquefaction zone or zones. On donation of the hydrogen at coal liquefaction conditions, the stability of the now unsaturated compound is retained. In the instance of an aromatic compound, the aromatic compound contains hydroaromatic hydrogen which can be donated while the aromatic compound remains stable at coal liquefaction conditions. In general, the heterocyclic oxygen or sulfur compound, or admixture of such compounds, boils within the range from about 250° F. to about 850° F., and preferably from about 290° F. to about 700° F.

In accordance with the practice of this invention, the polar compound, or admixture of such compounds, is added to a liquid fraction separated from the liquid boiling within the range from about 350° F. to about 850° F. and, preferably, from about 400° F. to about 700° F. These fractions have been found admirably suitable as a solvent donor, solvent donor vehicle or precursor, and generally contain about 30 percent and, most often, about 50 percent of an admixture of hydrogen donor compounds adequate to supply the necessary hydrogen under coal liquefaction conditions based on the total weight of the recycled solvent. Where such amounts of hydrogen donor compounds are not present in a given solvent vehicle, additional amounts of these materials can be added. Suitably, the polar compound is added to the solvent fraction in quantity ranging from about 3 to about 50 percent, preferably from about 5 to about 20 percent based on the weight of total solvent fed into the coal liquefaction zone.

Preferred hydrogen donor compounds added to, or originally contained within a suitable solvent donor vehicle, include indane, dihydronaphthalene, $C_{10}$–$C_{12}$ tetrahydronaphthalenes, hexahydrofluorine, the dihydro-, tetrahydro-, hexahydro- and octahydrophenanthrenes, $C_{12}$–$C_{13}$ acenaphthlenes, the tetrahydro-, hexahydro- and decahydro-pyrenes, the dihydro-, tetrahydro-, hexahydro-, and octahydro-anthacenes, and other derivatives of partially saturated aromatic compounds. In terms of hydrogen donor potential, the solvent to which the heterocyclic oxygen or sulfur compound is added, at the time of its introduction into or use within the coal liquefaction zone, necessarily contains at least about 0.8 percent, and preferably from about 1.2 to about 3 percent of donatable hydrogen based on the weight of total solvent introduced into the coal liquefaction zones. The preferred hydrogen donor solvent is one produced within the coal liquefaction process and one which contains suitable quantities of hydrogen donor precursors to which the polar compound is added.

In the best mode of practicing the present invention, schematically illustrated by reference to the figure, the required process steps include, generally (a) a mixing zone 10 within which particulate coal is slurried with an internally generated liquid solvent donor fraction, (b) a series of two coal liquefaction stages or zones, 20A, 20B, to the first of hich the coal slurry is fed and heated to a low temperature ranging from about 70° F. to about 750° F., preferably from about 600° F. to about 720° F. and the total effluent then fed to the second stage, or zone, and heated to a higher temperature, suitably to a temperature ranging from about 750° F. to about 950° F., preferably from about 800° F. to about 880° F. and the coal liquefied (c) a distillation and solids separation zone 30 within which a liquid solvent fraction, a 1000° F.+ heavy bottoms fraction, and a liquid product fraction are separated, and (d) a catalytic solvent hydrogenation zone 40 wherein the liquid solvent fraction is hydrogenated, and the hydrogenated solvent recycled as a hydrogen donor solvent to said coal liquefaction zones. Preferably, the polar compound is recycled with the solvent to the coal liquefaction zone but, if desired, can be removed from the recycle solvent.

Referring now to specific features of the process: In the mixing zone 10, particulate coal of size ranging up to about 1/8-inch particle size diameter, suitably 8 mesh (Tyler), is slurried in recycle solvent. The solvent and coal are admixed in a solvent-to-coal ratio ranging from about 0.8:1 to about 2:1, preferably about 1.2:1 to about 1.6:1 based on weight. The solvent is one which boils within the range from about 350° F. to about 850° F., preferably from about 400° F. to about 700° F. The coal slurry is fed, with molecular hydrogen, into the coal liquefaction zone 20.

Within the coal liquefaction zone 20A, the coal is heated to a relatively low temperature, preferably to a temperature within the range from about 600° F. to about 720° F., at which temperature the coal may be dispersed and solubilized. The total effluent is then fed into coal liquefaction zone 20B and the coal is therein heated to a higher temperature, preferably at a temperature ranging from about 800° F. to about 880° F. Residence time within zones 20A, 20B, respectively, ranges from about 20 minutes to about 150 minutes, preferably from about 30 minutes to about 120 minutes and from about 10 minutes to about 70 minutes, preferably from about 15 minutes to about 50 minutes. Pressures are not critical, ranging from about 300 psig to about 3000 psig, preferably from about 800 psig to about 2000 psig. Preferably molecular hydrogen is also added to the liquefaction zones 20A, 20B at a rate from about 1 to about 6 weight percent (MAF coal basis).

The product from the coal liquefaction zones 20A, 20B consist of gases and liquids, the liquids including a mixture of undepleted hydrogen-donor solvent, depleted hydrogen-donor solvent, dissolved coal, undissolved coal and mineral matter. The liquid matter is then transferred into a separation zone 30 wherein light fractions boiling below 400° F. useful as fuel gas are recovered, and intermediate fractions boiling from about 400° F. to about 850° F. are recovered for use as a hydrogen donor solvent. Heavier fractions boiling from about 700° F. to 1000° F. are also recovered, and bottoms fractions boiling above 1000° F., including char, are withdrawn for use in gasification or for coking, as desired.

The solvent fraction, or 400°–850° F. fraction, is introduced into a solvent hydrogenation zone 40 and hydrogenated in the presence of a polar compound to upgrade the hydrogen content of that fraction. The conditions maintained in hydrogenation zone 40 effectively hydrogenate and, if desired, conditions can be provided which produce substantial cracking. Temperatures normally range from about 500° F. to about 1000° F., preferably from about 640° F. to about 750° F., and pressures suitably range from about 650 psig to about 2000 psig, preferably from about 1000 psig to about 1400 psig. The hydrogen treat rate ranges generally from about 500 to about 10,000 SCF/B, preferably from about 1000 to about 5000 SCF/B.

Conventional hydrogenation catalysts can be employed in the hydrogenation zone 40. Typically, such catalysts comprise an alumina or silica-alumina support carrying one or more Group VIII non-noble, or iron group metals and one or more Group VIB metals of the Periodic Table. In particular, combinations of one or more Group VIB metal oxides or sulfides with one or more Group VIII metal oxides or sulfides are preferred. Typical catalyst metal combinations include oxides and/or sulfides of cobalt-molybdenum, nickel-molybdenum, nickel-tungsten, nickel-molybdenum-tungsten, cobalt-nickel-molybdenum and the like. A suitable cobalt molybdenum catalyst is one comprising from about 1 to about 10 weight percent cobalt oxide and from about 5 to about 40 weight percent molybdenum oxide, especially about 2 to 5 weight percent cobalt and about 10 to 30 weight percent molybdenum. Methods for the preparation of these catalysts are well known in the art. The active metals can be added to the support or carrier, typically alumina, by impregnation from aqueous solutions followed by drying and calcining to activate the composition. Suitable carriers include, for example, activated alumina, activated alumina-silica, zirconia, titania, etc., and mixtures thereof. Activated clays, such as bauxite, bentonite and montmorillonite, can also be employed.

These and other features of the present process will be better understood by reference to the following exemplary data. All units are in terms of weight unless otherwise specified.

EXAMPLES

Examples 1 and 2

Comparative tests, recorded herein as Runs 323, 324, were conducted to demonstrate the effectiveness of staged temperature coal liquefaction. In these tests, specified quantities of Illinois #6 coal and donor solvent were charged into each of four tubing bombs.

The coal used was crushed to −100 mesh (Tyler) and sifted to the desired size to provide a representative sample. A partially hydrogenated creosote oil (pHCO) which contained 2.0 weight percent of donatable hydrogen was employed as the solvent, and the solvent-to-coal ratio was 1.6:1. Twenty weight percent of β-picoline (Run 324) was added to two of the bombs. No β-picoline was added to the other two bombs (Run 323).

The initial hydrogen gas charge to each bomb was 500 psig at 75° F., this corresponding to about 2.3 Wt% of molecular hydrogen based on coal.

Each of the bombs was then sealed, and each sealed tubing bomb was first fixed in a bomb holder and attached to an agitating system before it was lowered into a heated sandbath. In a first stage (predissolving stage), a tubing bomb was heated to a temperature of 690° F. by immersing the bomb in a preheated sandbath and, after a predetermined residence time of 25 minutes, at this temperature the bomb was then withdrawn from the sandbath. In this second stage (liquefaction stage), the bomb was heated to a temperature of 840° F. at a residence time of 25 minutes. In each instance, the agitation was controlled at a frequency of 120 cycles per minute.

After liquefaction, each bomb was depleted of gas. The gas volume was measured by displacement of water in a glass bomb and the gas composition was measured by gas chromatography. The slurry recovered from each bomb was washed by mixing it for five minutes with cyclohexane in an amount equal to ten times its weight. The mixture was then centrifuged for ten minutes at a speed of 2000 RPM. The upper layer, which was rich in cyclohexane, was decanted and the remaining bottom layer was remixed with cyclohexane and again washed. This procedure was performed a total of ten times. The amount of slurry from each bomb that did not dissolve in the cyclohexane was measured and the respective values of two bombs for each run was averaged to yield an average cyclohexane insoluble.

The results are given in Table I, comparisons being made between Runs 323 and 324 respectively, these sets of runs having been made on the same date at the same time in duplicate runs.

TABLE I

STAGED TEMPERATURE LIQUEFACTION

| Run No. | 323 | 324 |
|---|---|---|
| Liquefaction Information | | |
| Temperature, ° F | 690,840 | 690,840 |
| Pressure, psig | 1310,1970 | 1310,1790 |
| Residence Time, Min. | 25,25 | 25,25 |
| Coal Type | Ill. #6 −100 Mesh | Ill. #6 100 Mesh |
| Solvent Type | PHCO-31 (D.H.-2.0%) | PHCO-31 β-Picoline |
| Dry Feed, g | 3.00 | 3.00 |
| Solvent, g | 4.80 | 4.80 0.60 |
| Solvent/Feed, Wt. Ratio | 1.6/1 | 1.8/1 |
| $H_2$Feed, Wt% Dry Coal | 2.3 | 2.3 |
| Agitation Rate, Cycle/Min | 120 | 120 |
| Yields, Wt% Dry Coal | | |
| Molecular $H_2$ Consumption | 0.30 | 0.35 |

TABLE I-continued

| STAGED TEMPERATURE LIQUEFACTION | | |
|---|---|---|
| Run No. | 323 | 324 |
| Gas Make | 6.35 | 6.25 |
| $CO_x$ | 1.96 | 1.66 |
| $H_2S$ | 0.48 | 0.49 |
| $C_1$–$C_3$ | 3.24 | 3.72 |
| $C_4$+ | 0.67 | 0.37 |
| Solid Residue | 52.5 | 46.1 |
| Liquid Make + $H_2O$ Make | 41.4 | 48.0 |
| Δ Liquid Make | Base | 6.6 |

Having thus described and illustrated the invention what is claimed is:

1. A process for liquefying a particulate coal feed to produce useful petroleum-like liquid products, which comprises:

(a) contacting, in a series of coal liquefaction zones, graded with respect to temperature such that the temperature ascends from the initial to the final zone of the series, an admixture of a polar compound selected from the group consisting the low molecular weight heterocyclic oxygen compounds containing from about 2 to about 6 fused rings, one or more of which is a five- or six-membered heterocyclic ring having from four to five carbon atoms in the nucleus and from one to two atoms of oxygen and the low molecular weight heterocyclic sulfur compounds containing from 2 to about 6 fused rings, one or more of which is a five- or six-membered heterocyclic ring having from four to five carbon atoms in the nucleus and from one to two atoms of sulfur a hydrogen donor solvent and particulate coal;

the initial zone being maintained at a temperature between about 70° F. and 750° F. while providing a residence time ranging from about 20 minutes to about 150 minutes to disperse the coal, and the final zone being maintained at a temperature between about 750° F. and 950° F. while maintaining a residence time ranging from about 10 minutes to about 70 minutes, sufficient to hydroconvert and liquefy the coal, (b) separating the product from the coal liquefaction zone into fractions inclusive of a liquid solvent fraction with contains at least 30 weight percent hydrogen donor compounds, (c) hydrogenating said liquid solvent fraction in a hydrogenation zone, and (d) recycling the hydrogenated liquid solvent mixture to the initial zone of the series.

2. The process of claim 1 wherein the polar compound is a low molecular weight heterocyclic oxygen compound containing from 2 to about 6 fused rings, one or more of which is a five- or six-membered heterocyclic ring having from 4 to 5 carbon atoms in the nucleus, and from 1 to 2 atoms of oxygen.

3. The process of claim 1 wherein the polar compound is a low molecular weight heterocyclic sulfur compound containing from 2 to about 6 fused rings, one or more of which is a five- or six-membered heterocyclic ring having from 4 to 5 carbon atoms in the nucleus, and from 1 to 2 atoms of sulfur.

4. The process of claim 1 wherein the temperature within the initial zone of the series ranges from about 600° F. to about 720° F.

5. The process of claim 1 wherein the residence time within the initial zone of the series ranges from about 30 minutes to about 120 minutes.

6. The process of claim 1 wherein the temperature within the final zone of the series wherein the coal is hydroconverted and liquefied ranges from about 800° F. to about 880° F.

7. The process of claim 1 wherein the residence time within the final zone of the series wherein the coal is hydroconverted and liquefied ranges from about 15 minutes to about 50 minutes.

8. The process of claim 1 wherein a total of from 2 to about 10 stages are provided to disperse, hydroconvert and liquefy the coal.

9. The process of claim 8 wherein from about 2 to about 5 stages are provided.

10. The process of claim 1 wherein the liquid solvent fraction contains at least 50 weight percent of hydrogen donor compounds.

11. The process of claim 10 wherein the liquid solvent fraction is one boiling within about a 350° F. to 850° F. range.

12. The process of claim 1 wherein the polar compound is added to the solvent in concentration ranging from about 3 to about 50 percent, based on the weight of the feed.

13. The process of claim 12 wherein the concentration of the polar compound ranges from about 5 to about 20 percent.

* * * * *